US009193064B2

(12) United States Patent
Dall'Armi et al.

(10) Patent No.: US 9,193,064 B2
(45) Date of Patent: Nov. 24, 2015

(54) PERSONAL POSITIONING CREEPER

(71) Applicant: The Ez Creeper Company Inc., London (CA)

(72) Inventors: Vivian Dall'Armi, London (CA); Gilles Rancourt, London (CA)

(73) Assignee: THE EZ CREEPER COMPANY INC., London, Ontario (CA)

( * ) Notice: Subject to any disclaimer, the term of this patent is extended or adjusted under 35 U.S.C. 154(b) by 0 days.

(21) Appl. No.: 14/280,599

(22) Filed: May 17, 2014

(65) Prior Publication Data

US 2014/0339783 A1 Nov. 20, 2014

Related U.S. Application Data

(60) Provisional application No. 61/824,616, filed on May 17, 2013.

(51) Int. Cl.
*B25H 5/00* (2006.01)

(52) U.S. Cl.
CPC ..... *B25H 5/00* (2013.01)

(58) Field of Classification Search
CPC ..... B25H 5/00
USPC ..... 280/32.6, 643
See application file for complete search history.

(56) References Cited

U.S. PATENT DOCUMENTS 4,895,380 A * 1/1990 Brooks et al. ..... 280/32.6
5,472,219 A 12/1995 Eckstrum
5,790,997 A * 8/1998 Ruehl ..... 5/618
6,095,532 A * 8/2000 Martin ..... 280/32.6
6,199,877 B1 * 3/2001 Shockley ..... 280/32.6
6,425,590 B1 * 7/2002 Whiteside et al. ..... 280/32.6
6,578,857 B1 * 6/2003 Whiteside et al. ..... 280/32.6
6,702,305 B2 * 3/2004 Miles ..... 280/32.6
6,834,868 B1 * 12/2004 Blackburn ..... 280/32.6
6,871,861 B2 * 3/2005 Hernandez, Jr. ..... 280/32.6
6,908,154 B2 * 6/2005 Aono ..... 297/330

(Continued)

FOREIGN PATENT DOCUMENTS

NO WO 9815391 4/1998

OTHER PUBLICATIONS

Ez Creeper Brochure for the RAA Convention and Tradeshow May 21-24, 2012 in Minneapolis Minn.

(Continued)

*Primary Examiner* — Jeffrey J Restifo

(57) ABSTRACT

A personal positioning creeper (PPC) for assisting mechanics, technicians and factory workers who need access to various angles and heights on a vehicle, aircraft, factory equipment, etc. The PPC allows the operator to simultaneously maneuver from lying supine near the ground, to moving upward and rotating into a full sitting position without having to dismount the PPC. The PPC comprises: a three member frame system (base, seat, and backrest frame connected together with eight (8) bell cranks and four (4) linkage assemblies), all under the control of a hydraulic system. The hydraulic system comprises: 1) a hydraulic pump with an ergonomically designed pump actuator handle and a release valve; and, 2) a hydraulic cylinder connected to the hydraulic pump, and to the linkage assemblies to rotate the bell cranks. The resistance to the pumping action felt by the operator remains constant regardless of the height of the seat.

20 Claims, 5 Drawing Sheets

(56) References Cited

U.S. PATENT DOCUMENTS

| | | | | |
|---|---|---|---|---|
| 6,966,564 | B2 * | 11/2005 | Hernandez, Jr. | 280/32.6 |
| 6,969,077 | B2 * | 11/2005 | Liu | 280/30 |
| 7,025,421 | B1 * | 4/2006 | Fowler et al. | 297/354.13 |
| 7,070,189 | B2 * | 7/2006 | Grauss | 280/32.6 |
| 7,188,843 | B2 * | 3/2007 | Magness | 280/30 |
| 8,777,237 | B2 * | 7/2014 | Brittingham et al. | 280/32.6 |
| 2005/0023780 | A1 * | 2/2005 | Liu | 280/32.6 |
| 2007/0235960 | A1 * | 10/2007 | Pantaleoni | 280/32.6 |
| 2008/0157492 | A1 * | 7/2008 | Chaykin et al. | 280/32.6 |
| 2012/0139198 | A1 | 6/2012 | Wang | |
| 2012/0235371 | A1 * | 9/2012 | Smith | 280/32.6 |
| 2014/0339783 | A1 * | 11/2014 | Dall'Armi et al. | 280/32.6 |
| 2015/0084293 | A1 * | 3/2015 | Huang | 280/32.6 |

OTHER PUBLICATIONS

Twombly, "Ez Creeper", AOPA's Pilot Magazine issue of Dec. 2013.

* cited by examiner

PERSONAL POSITIONING CREEPER

CROSS-REFERENCE TO RELATED APPLICATIONS

This application claims the benefit of U.S. Provisional Appl. 61/824,616, filed May 17, 2013, which is incorporated herein by reference in its entirety.

FIELD OF THE DISCLOSURE

The present disclosure relates generally to mechanic hand tools or equipment, and more specifically a creeper device to support a mechanic and/or technician in maneuvering around and under an aircraft and/or an automobile.

BACKGROUND OF THE DISCLOSURE

Creeper devices are widely used in factory, repair, and technical equipment work, and generally comprise horizontal platforms close to the ground that operators rest upon to work on equipment overhead. Creeper devices normally have castor wheels to enable the operator to easily maneuver around without getting off of the device. Some current creepers also have the ability to allow the operator to partially sit-up in a reclining position.

The repair and maintenance of equipment, such as small airplanes and helicopters, often require the technician, while maneuvering on a creeper to reach higher than arm length alone would allow. In such cases creeper devices that are usually used in other repair industries, such as the automotive industry, are not suitable because their height above the floor is fixed. In this situation the technician may have to either sit up (if there is enough head room) or use some other method such as cushions, foam pads, etc. to prop him/herself up to a suitable height to continue working.

Most automobile creeper devices allow the operator to be in a completely supine position close to the ground, while providing wheels on the bottom of the device to enable the mechanic to easily maneuver his position beneath the automobile by using his hands and/or feet pushing against the ground. For example, US Patent Application 20120139198 by Wang and U.S. Pat. No. 5,472,219 issued to Eckstrom disclose horizontal creeper devices that are positioned parallel to and a few inches off of the ground.

A few automobile creeper designs permit the mechanic to adjust their working height, usually by providing an adjustable back rest that can be raised from the horizontal to a discrete number of semi reclined positions. However they require the operator to roll out from beneath the vehicle, and dismount from the creeper to make the adjustment change and to once again roll back into position. Others may permit the mechanic to make the adjustments while mounted by applying a significant amount of force to a hand control, and possibly causing jerky, uncomfortable movements of the device and the mechanic.

For example, U.S. Pat. No. 4,895,380 issued to Brooks et al discloses a creeper that can be raised and lowered, and also to be separately positioned with a reclining back frame by a mounted operator having to first disengage a pair of gears, and then repeatedly pump on a hydraulic jack handle to permit hydraulic pressure to raise half of the back frame into a reclining position. The raising of the device and moving into a reclining position are separate actions; therefore, if an operator wanted to do both, he would have to follow a sequence of time consuming steps.

Likewise, PCT/NO97/00058 by Grimstad relies on two scissor members situated between two parallel frame members with a hydraulic pumping system to raise a creeper, and a separate lockable gas cylinder near the operator's back to adjust it into a reclining position. To raise the device, a manual hydraulic pump under the seat is activated that causes the scissor members to move to separate the frame members. A pump arm has to be repeatedly moved up-and-down by the operator to generate enough hydraulic pressure to raise the device. And the pressure the operator needs to apply is not constant throughout the range of motion. For example, when the device is in the supine position near the ground, the operator must exert a significant force on the pump arm in order to force the device to rise up.

Therefore, there is a need for an improved creeper device specifically designed for an operator (e.g. a mechanic, technician, factory worker, etc.) to easily and comfortably maneuver beneath vehicles, such an aircraft, truck and other equipment, in order to reach components situated at various heights and angles. The operator should be able to adjust his/her working height quickly and with minimal effort, and the creeper should be ergonomically designed to maximize comfort and efficiency.

SUMMARY OF THE DISCLOSURE

The various embodiments of the present disclosure comprise an improved personal positioning creeper (PPC) device for assisting an operator in positioning themselves to perform work overhead, such as within a factory, or maintenance work beneath an aircraft and/or automobile. The PPC primarily comprises: a frame system; and, a lifting/reclining mechanism activated by a hand powered hydraulic system. The frame system is composed of a rectangular shaped base frame with swivel casters on each of the four corners, a seat frame, and a backrest frame. The seat and backrest frames respectively support a seat cushion, and a back-rest cushion with attached head-rest. All cushions are padded and vinyl covered for operator comfort. The frame system further comprises a brace member with pivot joints for proper stability. This is essentially a straight metal bar that has one end connected through a pivot joint to the base frame and the opposite end connected through another pivot joint to the bottom of the seat frame.

The lifting and reclining system comprises: 1) a hydraulic system to raise and lower the PPC seat at various positions while remaining parallel to the ground; and, 2) a pivoting connection between the seat frame and the backrest frame to simultaneously raise the PPC from the lowest horizontal (supine) position to an elevated-reclining or seated position. Thus, when the operator activates the hydraulic system, the PPC will simultaneously raise the seat frame while moving the backrest frame into an elevated reclining position, in a manner similar to a reclining armchair. The operator is therefore able to smoothly shift to any position from the lowest horizontal (supine) to the highest (sitting up) position, and anywhere through the infinite number of reclined positions. In the lowest position the body lays horizontal at about 10 inches from the ground while in the highest position the seat is about 18 inches from the ground while the back-rest is at an angle of about 20 to 30 degrees from the vertical. In this position the shoulders of a typical height operator are about 40 inches from the ground.

The frame system, and lifting and reclining system are connected to each other by a series of linkages (e.g. straight metal bar members) joining pairs of bell cranks. Additionally, the base frame and the seat frame are connected to each other via two pairs of ninety-degree lower bell cranks (one pair per each long side of the seat frame) and two pairs of ninety-degree upper bell cranks (again one pair on each long side of the seat frame), for a total of eight bell cranks. And, each bell crank within each pair is further connected to each other via an outer (lower pair) and inner (upper pair) linkage member for a device total of 4 linkage members.

In one embodiment, the linkage members may comprise a straight metal bar member situated parallel to the seat frame and connecting the two lower crank pair and another bar member connecting the upper crank pair. The linkage members enable the lower bell crank pairs on both sides of the seat member to move in unison, and likewise for the upper bell crank pairs. Concurrently, the linkage members enable the lower bell crank pairs to rotate in opposite directions to the upper bell crank pairs. The linkage members are also connected to the hydraulic cylinder residing in between and in parallel with the linkage members. Therefore, the hydraulic pressure within the hydraulic cylinder generates the energy to raise up and rotate the bell cranks, thus causing the seat frame to elevate horizontally while concurrently raising the incline of the backrest towards a seated or reclining position.

The hydraulic system comprises: 1) a hydraulic pump assembly mounted on the right side of the PPC near the pivoting junction between the seat frame and backrest frame, and comprising the components of a hydraulic pump with an ergonomically designed pump actuator handle and a release valve; and, 2) a hydraulic cylinder residing below and in parallel to the seat frame and connected to the hydraulic pump assembly. The handle swings in an arc that lays parallel to the back-rest frame to permit the operator to push the handle away from the shoulder when the operator is reclined regardless of the degree of recline. When the operator pumps the handle, hydraulic pressure increases in a hydraulic cylinder residing below the seat and connected to the hydraulic pump assembly. The hydraulic cylinder is also connected to both outer linkage members via a rear, head trunnion and to the inner linkage members via a front trunnion. This configuration will in turn deliver the lifting force on the lower and upper bell crank pairs causing the seat frame to elevate while the backrest frame rotates from the horizontal into a proportional reclined position. And, when the release valve on the hydraulic assembly is opened the hydraulic pressure is reduced in the hydraulic cylinder, thus causing the seat frame to lower while rotating the backrest frame towards the supine position.

The pivoting connection of the lifting and reclining system comprises the following mechanism to enable the backrest frame to automatically rotate in conjunction with the raising and lowering of the seat frame. The backrest frame is hinged to the back of the seat frame by two pivots joints, and extends with 2 arms one on each side of the PPC to the underside of the base frame where they are fitted with rollers. The rollers are free to roll longitudinally on the underside of the base frame while keeping the ends of the back-rest arm-extensions at the same elevation regardless of the elevation of the seat/back-rest pivot. When the seat frame moves upward, the position rollers will move backwards along the underside of the base frame thereby lifting the head end of the PPC.

The various embodiments of the present disclosure are a design improvement on existing maintenance creeper devices. The first core improvement to the various embodiments comprises the bell crank-frame-linkage system for changing the device's seat height and incline position. The bell crank-frame-linkage configuration substantially decreases the force required to operate the pump when initiating lift from the PPC's lowest position as compared to the prior art. This results in a system where the operator applies a constant force throughout the range of motion of the PPC.

The second core design improvement comprises the custom-designed hydraulic lift system that provides the force to move the position of the PPC from the fully supine position to the upright seated, and/or elevated reclining position. This hydraulic system, in unison with the bell crank-frame-linkage lifting system, enables a constant pressure to be applied throughout the device, which is critical to the ergonomics and safe use of the device.

Accordingly, a primary objective of the various embodiments is to provide a PPC that does not require the operator to dismount in order to move it from one position to another, such as at any point between the range of motion comprising a supine position which is at ground-level to an elevated, reclining position.

Another objective is to provide a PPC that simultaneously activates via one control mechanism, such as a pump actuator handle, both vertically raising and rotating the PPC to a reclining position, as well as lowering and rotating it to a supine position, or to any position in between.

Another objective is to provide a PPC that allows the operator to stop the PPC at any point within its range of motion, as compared to the prior art that only allows mechanical creepers to stop at fixed positions.

And yet another objective is to provide a PPC that allows the operator to apply a constant low level force to the activation mechanism, such as the actuator handle, throughout the PPC's range of motion in order to move the PPC. As a result, the resistance to the pumping action felt by the operator remains constant regardless of the height of the seat.

BRIEF DESCRIPTION OF THE DRAWINGS

The above and other features, aspects, and advantages of the present disclosure will become better understood with regard to the following description, appended claims, and accompanying drawings where:

DETAILED DESCRIPTION OF EXAMPLE EMBODIMENTS

Figure 1:
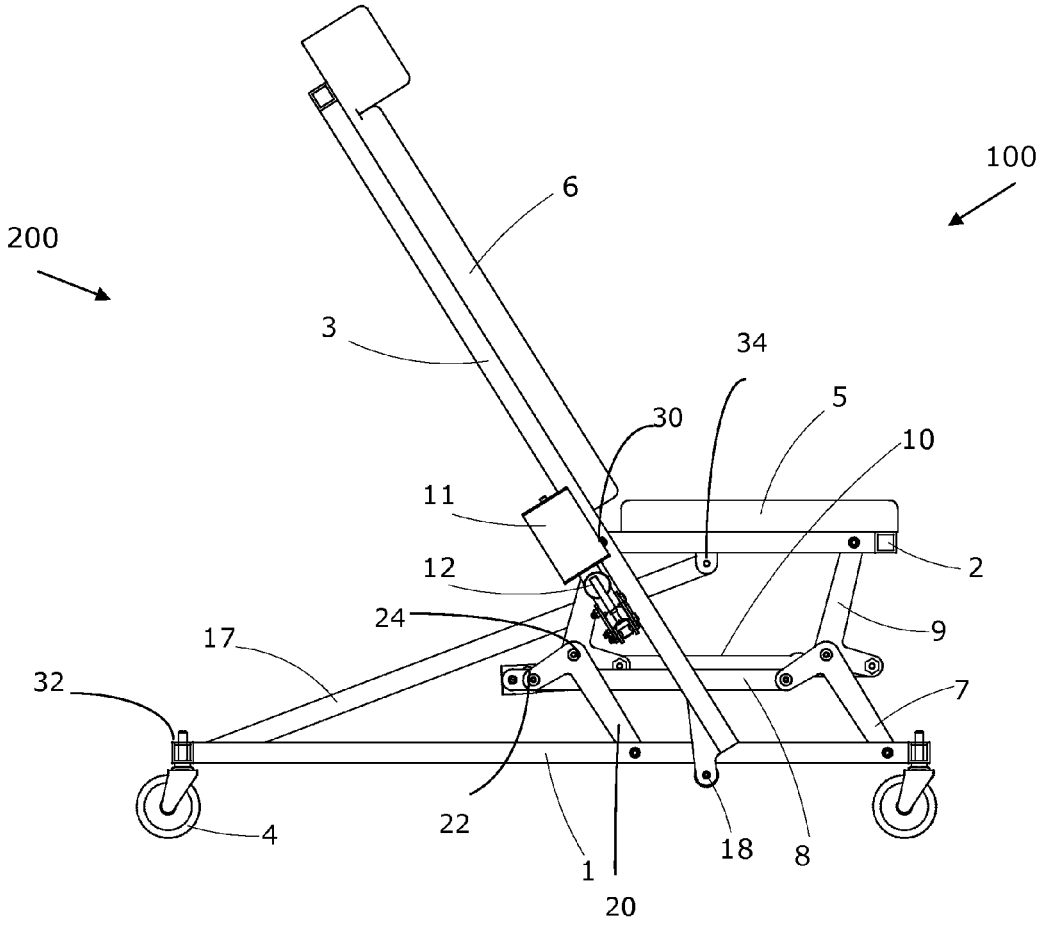
FIG. 1 a side elevation view of the device, adjusted to the vertical sitting position for the operator.
Figure 2:
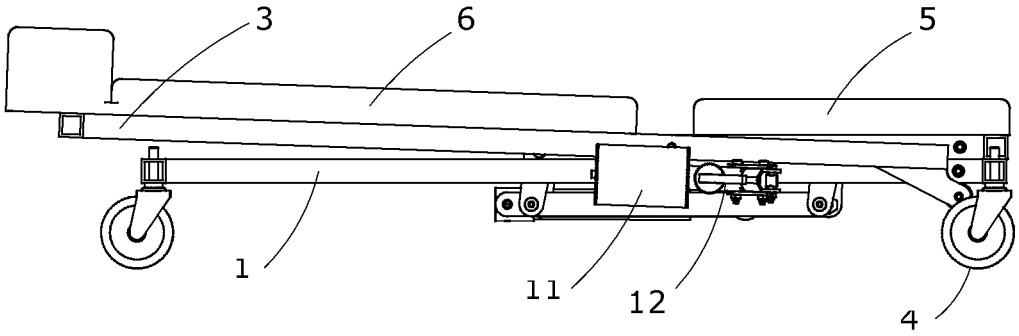
FIG. 2 a side elevation view of the device, in the lowest (reclining) position.
Figure 3:
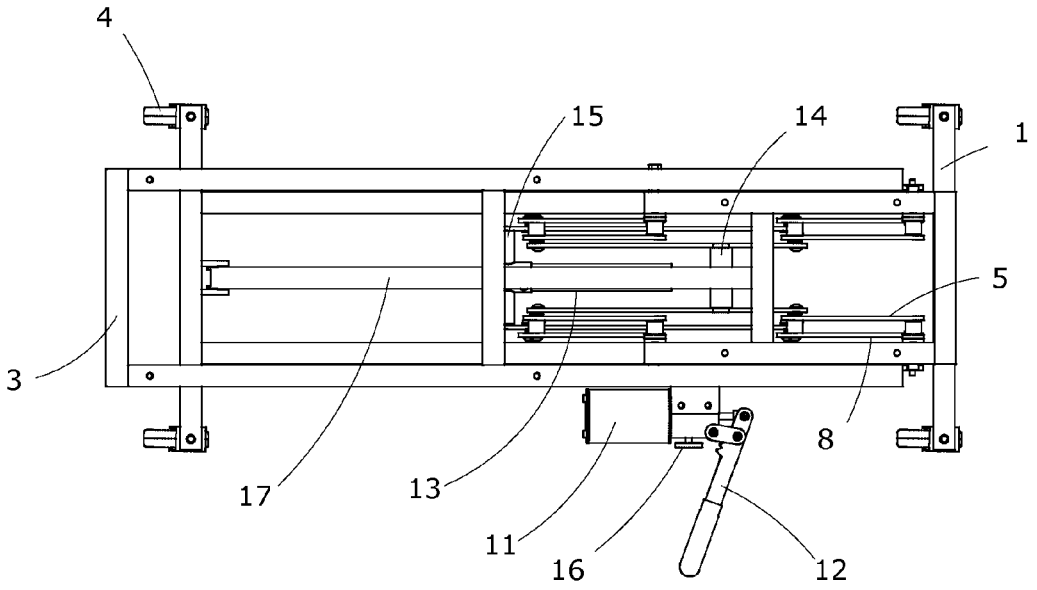
FIG. 3 is a top view of the device, shown without the seat frame pad to illustrate details of the mechanisms and their device.
Figure 4:
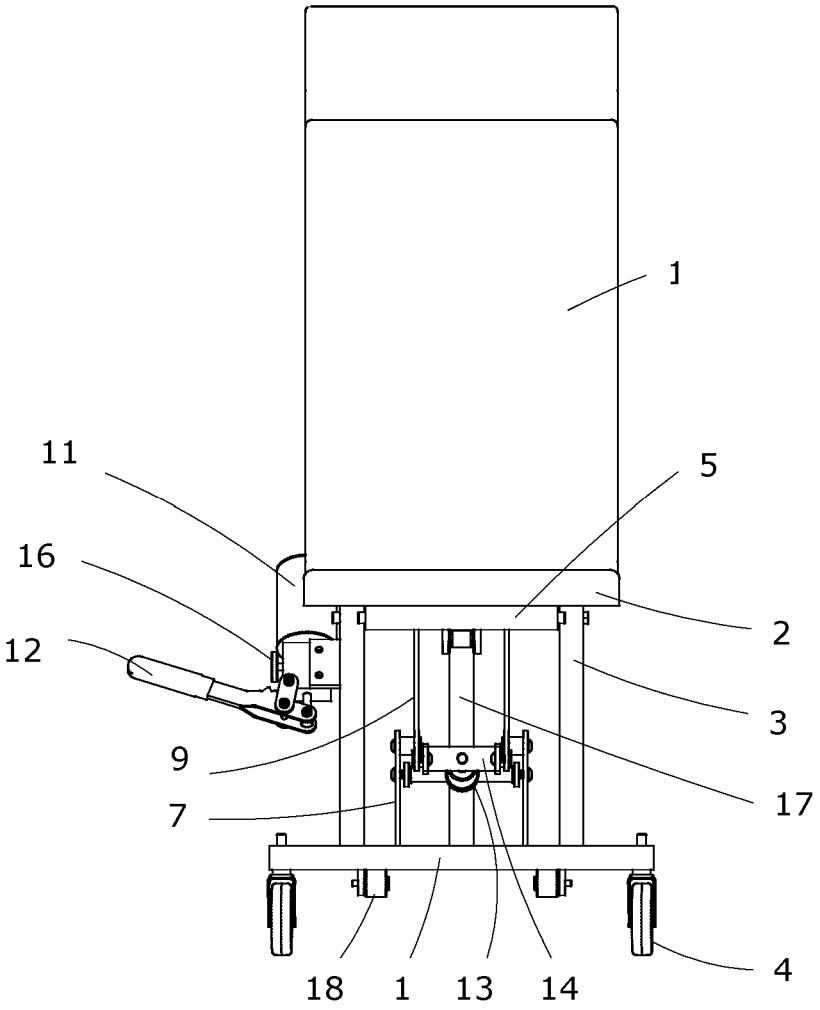
FIG. 4 is a front elevation view of the device, adjusted in the sitting position.

The present disclosure will be described more fully hereinafter with reference to the accompanying drawings, in which exemplary embodiments of the present invention are shown. The present invention may, however, be embodied in many different forms and is not construed as limited to the exemplary embodiments set forth herein.

As illustrated in FIGS. 1-5, the various embodiments of the present disclosure comprise: 1) a frame system; and, 2) a lifting and reclining system, in which the systems are connected together to form the PPC device with a foot end 100 and a head end 200 and two opposing sides, e.g. an operator's right and left side.

Frame System

The frame system is composed of the rectangular base frame 1 with two long sides and two short sides, the seat frame 2 and the backrest frame 3. The frame system may be constructed of high-grade, high-gauge aluminum tubing well-suited for industrial applications. The base frame 1 is equipped with a full swivel caster 4 attached to each of the four corners of the rectangular base frame 1. The casters allow for full mobility in all directions while the PPC is in motion. The seat frame 2 and backrest frame 3 may be covered by vinyl-enclosed pads 5 and 6 that are constructed of high-density foam designed with an ergonomic headrest for operator comfort.

The frame system and lifting and reclining system are connected to each other by a series of linkages and bell cranks. Specifically, the base frame 1 and the seat frame 2 are connected to each other via two pairs of ninety-degree lower bell cranks 7 (one pair per each long side of the base frame 1) and two pairs of ninety-degree upper bell cranks 9 (again one pair per each long side of the seat frame 2), for a total of eight bell cranks. And, each crank within a pair of bell cranks (i.e. the lower cranks 7 and the upper cranks 9) on each side of the device is further connected to each other via a linkage member, such as a straight metal bar linkage member 8 connecting the crank pair 7-8-7 and bar linkage member 10 connecting the crank pair 9-10-9, for a device total of 4 straight bar members. The linkage members enable the two bell crank pair 7,7 on both sides of the PPC to move in unison, and the two pair 9,9 on each side of the PPC to move in unison, and the pairs 7,7 to rotate opposite to pairs 9,9. The linkage members 8, 10 are also connected to the hydraulic cylinder 13, so that hydraulic pressure generates the energy to rotate the bell cranks thus causing the seat frame 2 to raise and lower.

Figure 5:
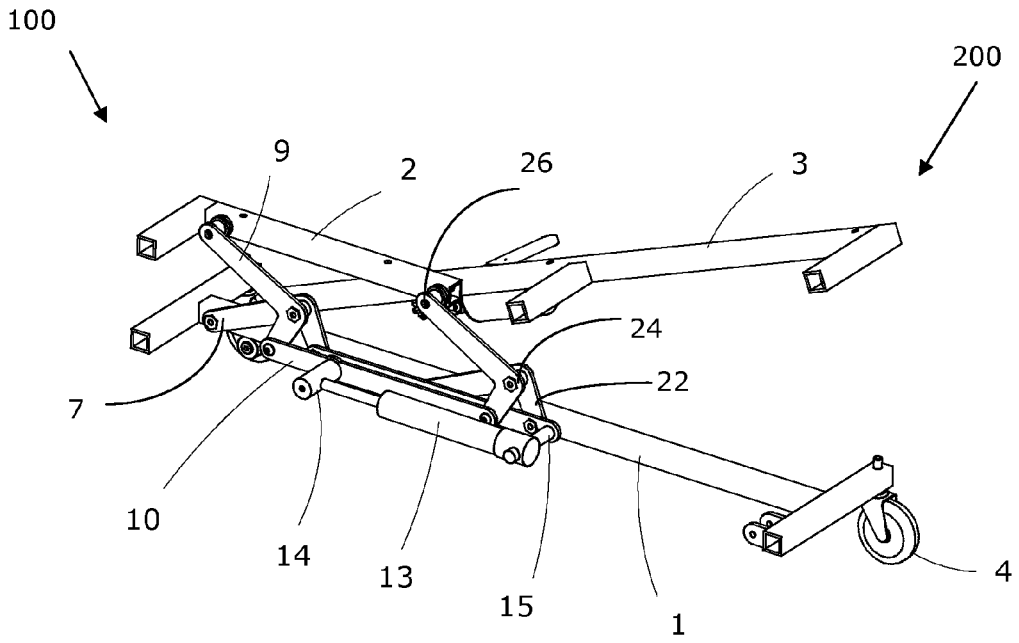
FIG. 5 is a perspective view of the cross-section (e.g. projection line down the middle of the device from head to foot) of the bell crank linkage assembly.

As illustrated further in FIGS. 1 and 5, each bell crank 7 has three connecting points: one at each end, comprising a long end 20 and a short end 22, and one near the center 24. On each long side of the base frame 1, a pair of lower bell cranks 7 are rigidly attached at the long end 20, to base frame 1 via a pivot joint. FIG. 5, which illustrates a projection line view of the PPC's longitudinal cross-section, further displays two lower bell cranks 7 and two upper bell cranks 9. One upper and lower bell crank 7, 9 are near the device's foot end 100, and one upper and lower bell crank are towards the middle of the device. An outer link 8 comprising a straight bar linkage member connects the short ends 22 of the lower bell crank 7 pair so that they move in unison. This end 22 of the lower bell crank 7 is also connected to the hydraulic cylinder 13 via a rear trunnion 15 (see FIG. 5).

On each long end of seat frame 2, a pair of upper bell cranks 9 are rigidly attached at their ends 26 to the four corners (2 of 4 bell cranks 9 shown in FIG. 5) of the seat frame 2. The two rear, head end upper bell cranks 9 (e.g. near middle of device) are also connected to the backrest frame 3 at ends 26. An inner link 10 connects the opposite ends of the upper bell crank 9 pair so they move in unison. This inner link 10 is connected to the hydraulic cylinder 13 via the front trunnion 14 (see FIG. 5). Each upper and lower bell crank pair is connected at their center pivots 24 and as such are able to rotate opposite each other. This action lifts or lowers the seat and backrest according to the pressure in the hydraulic system.

The PPC's frame system may further comprise a brace member for added stability. As illustrated in FIG. 1, the brace member 17 comprises a straight metal bar that has one end connected through a pivot joint 32 to the base frame 1 head end, and the opposite end to the underside of the seat frame 2 via a second pivot joint 34. The purpose of the brace member 17 is the longitudinal stabilization of the seat frame 2.

Lifting and Reclining System

The lifting and reclining system further comprises the hydraulic pump assembly 11, which is operated by a pump actuator handle 12 and a release valve 16. The pressure, hence the resistance to the pumping action felt by the operator, remains constant regardless of the height of the seat. This is due to the unique design of the bell crank and linkage assembly. To raise their position, the operator will act on the pump actuator handle 12, pushing it forward (away from shoulder). The pump handle 12 swings in an arc parallel to the backrest frame 3 and therefore always in line with the operator's shoulder regardless of the degrees of recline at the time.

To lower the PPC and return it to a supine position, the operator will slowly open the pressure release valve 16. Once the desired position has been reached the operator will close the valve to stop the movement.

When raising the device, the hydraulic pressure generated by the hydraulic pump assembly 11 is fed to the hydraulic cylinder 13. This cylinder is connected to both outer links 8 via the rear trunnion 15 and to the inner links via the front trunnion 14. This configuration will in turn deliver the lifting force on the bell cranks 7, 9 and finally the seat frame 2. When the seat frame 2 moves upward, the backrest frame 3 automatically rotates into a sitting, or elevated reclining position.

The backrest frame 3 rotates in conjunction with the raising and lowering of the seat member 2 via the following mechanism. As illustrated in FIG. 1, the backrest frame 3 is hinged to the back of the seat frame 2 by two pivots joints 30, one on each side of the PPC near the junction of the seat and back cushions, and guided against the bottom or underside of the base frame 1 by the two backrest position rollers 18, one on each side of the device. When the seat frame 2 moves upward, the backrest position rollers 18 will move backwards towards the head 200 of the base frame 1 thereby lifting the head end of the backrest frame 3 from the supine position.

Although the present disclosure has been fully described by way of example with reference to the accompanied figures-drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A simultaneously lifting and reclining personal positioning creeper (PPC), wherein the operator does not need to dismount the PPC to adjust its position, comprising, a. a rectangular shaped base frame comprising four swivel castors on the frame underside;

b. a cushioned, rectangular or square shaped seat frame residing above and parallel to the base frame;

c. a cushioned, rectangular shaped backrest frame rotatable in conjunction with raising and lowering of the seat connected via pivoting means:

i. at about a mid-section of the backrest frame to the head end of the seat frame, ii. at the underside of the base frame, d. a bell crank linkage assembly connecting the base, seat and backrest frames, via four pairs of bell cranks with four linkage members;

e. a hydraulic system with an activation mechanism configurable to control the PPC movement; and, f. wherein the operator may adjust the PPC to stop anywhere within a range of motion, from a supine position to an elevated-reclining or sitting position, by applying a low level force to the activation mechanism.

2. The PPC of claim 1, wherein the hydraulic system comprises, a. a hydraulic pump assembly comprising a hydraulic pump connected to an activation mechanism comprising a pump actuator handle and a pressure release valve; and, b. a hydraulic cylinder connected to the hydraulic pump assembly.

3. The PPC of claim 2, wherein the pump actuator handle is substantially in line with the backrest frame and an operator's shoulder, and the pumping action is away from the shoulder regardless of the PPC recline angle.

4. The PPC of claim 1 wherein the bell crank linkage assembly, further comprises, a. each crank comprising a long and short end, with the pairs residing between the seat frame and the base frame and organized into:

i. one pair of lower bell cranks on both sides of the PPC that are connected on the long end to the base frame, and on the short end to opposing ends of a linkage member;

ii. one pair of upper bell cranks on both sides of the PPC that are connected on the long end to the four corners of the seat frame, and on the short end to opposing ends of a linkage member; and, b. wherein the linkage members enable the bell cranks within each pair to move in unison, and the upper pair to rotate counter to the lower pair.

5. The PPC of claim 4 wherein each linkage member further comprises a straight bar with a pivot joint on the opposing ends of the bar.

6. The PPC of claim 5, configurable to simultaneously raise and lower the seat frame while rotating the backrest frame via:

a. the hydraulic cylinder connected to the linkage members to cause the seat frame and backrest frame to move concurrently when the pump actuator handle is repeatedly pumped and/or the release valve is opened; and, b. the upper bell crank on both sides of the PPC head end connected to the pivot joint joining the mid-section of the backrest frame to the head end of the seat frame.

7. The PPC of claim 6 wherein the release valve is opened by counterclockwise rotation to cause the seat frame to lower while rotating the backrest frame towards a or supine position.

8. The PPC of claim 1 further comprising a brace member for added stability, comprising a straight metal bar with a pivot joint on each end connecting the brace member to the head end of the base frame and to an underside of the seat frame.

9. A simultaneously lifting and reclining personal positioning creeper (PPC), wherein the operator does not need to dismount the PPC to adjust its position, the PPC with a head and foot end and two sides comprising, a. a four corned, rectangular shaped base frame comprising one swivel castor on the bottom of each corner;

b. a cushioned, rectangular or square shaped seat frame residing parallel to the base frame;

c. a cushioned, pivoting, rectangular shaped backrest frame extending from the PPC head end to the underside of the base frame, and connected:

i. at about a mid-section of the backrest frame to the head end of the seat frame via a pivot joint;

ii. at the underside of the base frame via position rollers;

iii. wherein the pivot joint and position roller enable the backrest frame to rotate the backrest frame in conjunction with raising and lowering the seat frame;

d. a hydraulic system that controls the raising and lowering of the seat frame in conjunction with the pivoting of the backrest frame, comprising, i. a hydraulic pump assembly comprising a hydraulic pump connected to pump actuator handle and to a pressure release valve;

ii. a hydraulic cylinder connected to the hydraulic pump assembly;

e. a bell crank and linkage assembly, comprising, of four pairs of two ninety degree bell cranks, each crank comprising a long and short end, with the pairs residing between the seat frame and the base frame and organized into:

i. one pair of lower bell cranks on both sides of the PPC that are connected on the long end to the base frame, and on the short end to opposing ends of an outer linkage member;

ii. one pair of upper bell cranks on both sides of the PPC that are connected on their long end to the four corners of the seat frame, and on the short end to opposing ends of a inner linkage member;

iii. wherein the two outer and the two inner linkage members each comprise a straight bar with a pivot of joints on the opposing ends of the bar; and, iv. wherein the linkage members enable the bell cranks within each pair to move in unison, and the upper pair to rotate counter to the lower pair;

f. wherein the operator may adjust the PPC to stop anywhere within a range of motion, from a supine position to an elevated-reclining or sitting position, by applying a low level force to the activation on mechanism.

10. The PPC of claim 9 is configurable to raise and lower the seat frame while rotating the backrest frame via:

a. the hydraulic cylinder connected to the linkage members to cause the seat frame and backrest frame to move concurrently when the pump actuator handle is repeatedly pumped and/or the release valve is opened; and, b. the upper bell crank on both sides of the PPC head end connected to the pivot joint joining the mid-section of the backrest frame to the head end of the seat frame.

11. The PPC of claim 9, wherein the release valve is opened by depressing the valve to cause the seat frame to lower while rotating the backrest frame towards a supine position.

12. The PPC of claim 9, wherein the pump actuator handle is substantially in line with the backrest frame and an operator's shoulder, and the pumping action is away from the shoulder regardless of the PPC recline angle.

13. The PPC of claim 9 further comprising a brace member for added stability, the brace member comprises a substantially straight metal bar with a pivot joint on each end to connect the brace member to the head end of the base frame and to an underside of the seat frame.

14. The PPC of claim 9, wherein the operator may adjust the PPC at any point within a range of motion by applying a constant, low level force to the pump actuator handle.

15. A method of moving the PPC throughout a range of motion from a supine position to an elevated, recline position, wherein the operator does not need to dismount the creeper, comprising the steps of, A. providing a PPC comprising, a. a rectangular shaped base frame comprising of four swivel castors on the frame underside;

b. a cushioned, rectangular or square shaped seat frame residing above and parallel to the base frame;

c. a cushioned, rectangular shaped backrest frame rotatable in conjunction with raising and lowering of the seat moveably connected:

i. at about a mid-section of the backrest frame to the head end of the seat frame;

ii. at the underside of the base frame;

d. a bell crank linkage assembly connecting the base, seat and backrest frames, via four pairs of bell cranks with four linkage members;

e. a hydraulic system with an activation mechanism configurable to control the PPC movement, comprising:

i. a hydraulic pump assembly comprising a hydraulic pump connected to pump actuator handle and to a pressure release valve;

ii. a hydraulic cylinder connected to the hydraulic pump assembly; wherein the operator may adjust the creeper to stop anywhere within a range of motion, comprising a supine position to an elevated-reclining or sitting position, by applying a low level force to the activation mechanism;

B. simultaneously lowering the seat and backrest frame towards the ground and rotating the backrest frame into a supine position by turning the release valve; and, C. simultaneously raising the seat and backrest frame vertically and rotating the backrest frame into a reclining position by pumping the actuator handle with a constant force throughout the range of motion.

16. The method of claim 15, wherein the bell crank linkage assembly, further comprises, a. each bell crank comprising a long and short end, with the pairs residing between the seat frame and the base frame and organized into:

i. one pair of lower bell cranks on both sides of the PPC that are connected on the long end to the base frame, and on the short end to opposing ends of a linkage member;

ii. one pair of upper bell cranks on both sides of the PPC that are connected on the long end to the four corners of the seat frame, and on the short end to opposing ends of a linkage member; and, b. wherein the linkage members enable the bell cranks within each pair to move in unison, and the upper pair to rotate counter to the lower pair.

17. The method of claim 16 wherein each linkage member further comprises a straight bar with a pivot joint on the opposing ends of the bar.

18. The method of claim 17, wherein the pump actuator handle is substantially in line with the backrest frame and an operator's shoulder, and the pumping action is away from the shoulder regardless of the PPC recline angle.

19. The method of claim 16, wherein the PPC is able to raise and lower the seat frame while rotating the backrest frame via:

a. the hydraulic cylinder connected to the linkage members to cause the seat frame and backrest frame to move concurrently when the pump actuator handle is repeatedly pumped and/or the release valve is opened; and, b. the upper bell crank on both sides of the PPC head end connected to the pivot joint joining the mid-section of the backrest frame to the head end of the seat frame.

20. The method of claim 15, wherein the operator adjusts the PPC to stop anywhere within a range of motion, comprising a supine position to an elevated-reclining or sitting position, by applying a low level force to the actuator handle.

* * * * *